US009574298B2

(12) United States Patent
Sartor et al.

(10) Patent No.: US 9,574,298 B2
(45) Date of Patent: Feb. 21, 2017

(54) LAUNDRY DRYER WITH ACCESSIBLE RECIRCULATION AIR FILTER

(71) Applicant: Electrolux Appliances Aktiebolag, Stockholm (SE)

(72) Inventors: Luciano Sartor, Conegliano (IT); Nicola Baruffaldi, Castelnuovo del Garda (IT); Flavio Noviello, Aviano (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 569 days.

(21) Appl. No.: 13/912,580

(22) Filed: Jun. 7, 2013

(65) Prior Publication Data

US 2014/0360040 A1 Dec. 11, 2014

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/02; D06F 58/22
See application file for complete search history.

(56) References Cited

U.S. PATENT DOCUMENTS

| | | | | |
|---|---|---|---|---|
| 1,486,402 | A | 3/1924 | Waream | |
| 1,959,491 | A | 5/1934 | Moran | |
| 2,314,748 | A | 3/1943 | White | |
| 2,422,825 | A | 6/1947 | Davis, Jr. | |
| 3,378,934 | A * | 4/1968 | Erickson | D06F 58/22 34/82 |
| 3,882,613 | A | 5/1975 | Wilson | |
| 4,665,628 | A | 5/1987 | Clawson | |
| 5,036,602 | A | 8/1991 | Coffman | |
| 6,966,124 | B2 | 11/2005 | Ryu | |
| 6,966,126 | B2 | 11/2005 | Baurmann | |
| 7,665,227 | B2 | 2/2010 | Wright et al. | |
| 7,802,375 | B2 | 9/2010 | Johnson | |
| 7,921,578 | B2 | 4/2011 | McAllister et al. | |
| 8,056,254 | B2 | 11/2011 | Loffler et al. | |
| 8,240,064 | B2 | 8/2012 | Steffens | |
| 2007/0039198 | A1 | 2/2007 | Boettcher et al. | |
| 2007/0151041 | A1 | 7/2007 | McAllister et al. | |
| 2007/0151311 | A1 | 7/2007 | McAllister et al. | |

(Continued)

FOREIGN PATENT DOCUMENTS

| | | | |
|---|---|---|---|
| JP | 2002-273088 | A | 9/2002 |
| JP | 2008-73308 | A | 4/2008 |

*Primary Examiner* — Jiping Lu
(74) *Attorney, Agent, or Firm* — Banner & Witcoff, Ltd.

(57) ABSTRACT

A laundry dryer is provided with an air recirculation channel which recirculates air from an air exhaust channel to an air supply channel. The air recirculation channel comprises a recirculation air filter which removes debris from the recirculated air before it is redirected to the air supply channel. The recirculation air filter is removably accessible behind an access door at a peripheral region of an access passage to the drying chamber such that it may be easily serviced by a user of the laundry dryer. In some embodiments, the air recirculation channel may comprise a nozzle with an outlet which is concentrically arranged at an inlet of the air supply channel. In these embodiments, the nozzle may direct the recirculated air to the air supply channel such that it is enveloped by fresh air entering from within a cabinet of the laundry dryer.

22 Claims, 15 Drawing Sheets

(56) References Cited

U.S. PATENT DOCUMENTS

| | | | | |
|---|---|---|---|---|
| 2007/0151312 | A1 | 7/2007 | Bruce et al. | |
| 2007/0163094 | A1 | 7/2007 | Wright et al. | |
| 2007/0163095 | A1 | 7/2007 | McAllister et al. | |
| 2010/0018262 | A1 | 1/2010 | Beihoff et al. | |
| 2010/0132217 | A1 | 6/2010 | Steffens | |
| 2010/0146811 | A1* | 6/2010 | Steffens ..... | D06F 58/22 34/480 |
| 2010/0154248 | A1 | 6/2010 | Stolze | |
| 2011/0005096 | A1 | 1/2011 | Stolze | |
| 2011/0016928 | A1 | 1/2011 | Beihoff et al. | |
| 2011/0030238 | A1 | 2/2011 | Nawrot et al. | |
| 2011/0198405 | A1 | 8/2011 | Krausch et al. | |
| 2012/0017464 | A1 | 1/2012 | Beers et al. | |
| 2012/0017465 | A1 | 1/2012 | Beers et al. | |
| 2012/0017615 | A1 | 1/2012 | Beers et al. | |
| 2012/0030959 | A1 | 2/2012 | Yang | |
| 2012/0030960 | A1 | 2/2012 | Ryoo et al. | |
| 2012/0090190 | A1 | 4/2012 | Yang | |
| 2012/0096739 | A1 | 4/2012 | Clark | |

* cited by examiner

LAUNDRY DRYER WITH ACCESSIBLE RECIRCULATION AIR FILTER

TECHNICAL FIELD

The present invention relates generally to laundry dryers. In particular, the invention relates to a vented laundry dryer that employs air recirculation.

BACKGROUND

During operation, a conventional vented tumble dryer draws air from the surrounding area, heats it, and directs it into the drying chamber or drum of the dryer. The dryer then exhausts the air and retained water vapor through a channel to the outside. As shown in FIGS. 1-3, a known vented dryer 100 generally includes a rotatable drum 102; an air supply channel 104 which introduces fresh air from within the dryer housing or cabinet 106 into the drum 102 via manifold 204; a heater 202 supplied at air supply channel 104, which heats the air introduced into the air supply channel 104; and an air exhaust channel 108 to exhaust hot air and water vapor from the dryer, typically to the outside of the house or other building in which the dryer is located. A process air fan or blower 110 is provided downstream of the drum 102 for drawing air through the system and out the exhaust channel 108. A lint filter 206 for collecting lint and other debris in the air is placed between the drum 102 and the exhaust channel 108. In such a vented tumble dryer 100, the sole heat source is the heater 202 upstream of the drum 102. Further, heat recovery may take place by a slight warming of the air in cabinet 106 before it is drawn into heater 202, by virtue of the heat in the cabinet 106 generated by continued operation of the dryer 100.

Some dryer systems use partially recirculated air in addition to the conventional heater to improve energy efficiency. These systems mix a portion of the exhaust air with the air being introduced into the drum. For example, commonly owned U.S. patent application Ser. No. 13/437,499, filed on Apr. 2, 2012, and titled "Dryer With Air Recirculation Subassembly," which is hereby incorporated by reference in its entirety, describes a dryer system using recirculated air to increase efficiency. In these systems, the warm, moisture-laden exhaust air holds the potential to absorb additional molecules of water when recirculated through the dryer, and thus the heat energy of that air can be reutilized to improve operating efficiency.

FIG. 4 illustrates an example vented recirculation dryer 400 with portions of cabinet 406 removed, which redirects at least a portion of exhausted air back to air supply channel 404 and ultimately to drum 402. Specifically, the recirculation dryer 400 is similar to vented dryer 100, except recirculation dryer 400 comprises air recirculation channel 414 connecting air exhaust channel 408 with air supply channel 404. Process air fan or blower 410 pulls air from drum 402 through a conventional lint filter 412. A first portion of this air is exhausted through exhaust channel 408, similar to the operation of exhaust channel 108 of vented dryer 100. However, a second portion of the air is recirculated back to air supply channel 404 via air recirculation channel 414, which is then combined with fresh air entering from cabinet 406 at inlet 416 and ultimately supplied back to drum 402 through air supply channel 404. Accordingly, during operation, air passing through air supply channel 404 (and across a heater within air supply channel 404, not shown) comprises air from cabinet 406 and recirculated air pulled from drum 402. In the right proportions, use of such a combination may increase the overall efficiency of vented dryer 400.

However, one concern with using recirculated air is that the recirculated air may contain lint and debris, even after passing through a conventional lint filter 412. That is, when heated air is pulled across articles in drum 402 by blower or fan 410, it may collect lint or debris from the articles. Although most dryers have a standard lint filter (e.g., lint filter 206 of vented dryer 100 shown in FIG. 2 or lint filter 412 of recirculation dryer 400 shown in FIG. 4) to remove most of this lint, some fine debris may inevitably remain in the exhaust air flow. Recirculating a portion of this exhaust air back toward the heater thus poses the risk that accumulated lint may ignite in the heater and be carried into drum 402.

Some recirculation dryers thus include a recirculation air filter, positioned in the air recirculation channel, to remove particulates left in the recirculated air. However, such filters require periodic cleaning and/or replacement, which can be difficult and require complex systems due to the location of the recirculation air channel. For example, with respect to recirculation dryer 400, a recirculation air filter may be located at the junction between exhaust channel 408 and air recirculation channel 414. But because exhaust channel 408 and air recirculation channel 414 meet in cabinet 406 below drum 402, the recirculation air filter is not readily accessible by a user. Thus, recirculation dryer 400 must be partially disassembled in order to service the recirculation air filter, or, alternatively, internal cleaners must be employed.

As a further example, G.B. Patent Appl. Publ. No. 1,369,713, filed Feb. 23, 1973, and titled "Improvements in or Relating to Direct-Air Tumbler-Driers and Air-Recirculatory Conversion Means Thereof," describes a recirculation air filter that may be periodically serviced through a service hatch provided in recirculation ductwork. Further, U.S. Pat. No. 8,240,064, filed Nov. 24, 2009, and titled "Dryer with Recirculated Air Proportion and Method for Its Operation," describes a recirculation air filter that is cleaned internally by internal scrapers and/or internal rinsing agents, or externally (although it is not clear how). Each of these solutions may add considerable cost or complexity to the dryer. Thus, there remains a need for an accessible recirculation air filter in a vented dryer employing air recirculation, which allows a user of the dryer to easily clean and/or replace the recirculation air filter.

BRIEF SUMMARY OF SELECTED INVENTIVE ASPECTS

The above and other drawbacks of existing recirculation air dryer designs are addressed by the present invention. According to one aspect of the invention, a vented dryer comprising an air recirculation system is provided. The air recirculation system directs a portion of exhausted air from a drying chamber to an air supply channel. The air recirculation system comprises a recirculation air filter. The recirculation air filter may remove debris, lint, or other particulates in the recirculated air before the air is directed back to an air supply channel. The recirculation air filter may be removably accessible by a user of the dryer. Specifically, the recirculation air filter may be removable and replaceable at a peripheral region of an access passage to the drying chamber. Accordingly, the filter may be easily accessed for cleaning and/or replacement by a user of a dryer by merely opening a door of the dryer.

In another aspect of the invention, an improved system for recirculating air is provided. Specifically, an outlet of an air recirculation channel may be concentrically arranged with an inlet of an air supply channel. The outlet of the air recirculation channel may form at a nozzle which directs recirculated air into the air supply channel. In certain embodiments, an inlet of the air supply channel may overlap an outlet of the air recirculation channel such that the outlet is positioned downstream of fresh air entering the inlet.

BRIEF DESCRIPTION OF THE DRAWINGS

The above and other features, aspects, and advantages of the invention will be fully apparent and understood from the following detailed description, taken together with the appended drawings, wherein.

DETAILED DESCRIPTION OF EXAMPLE EMBODIMENTS

Figure 5:
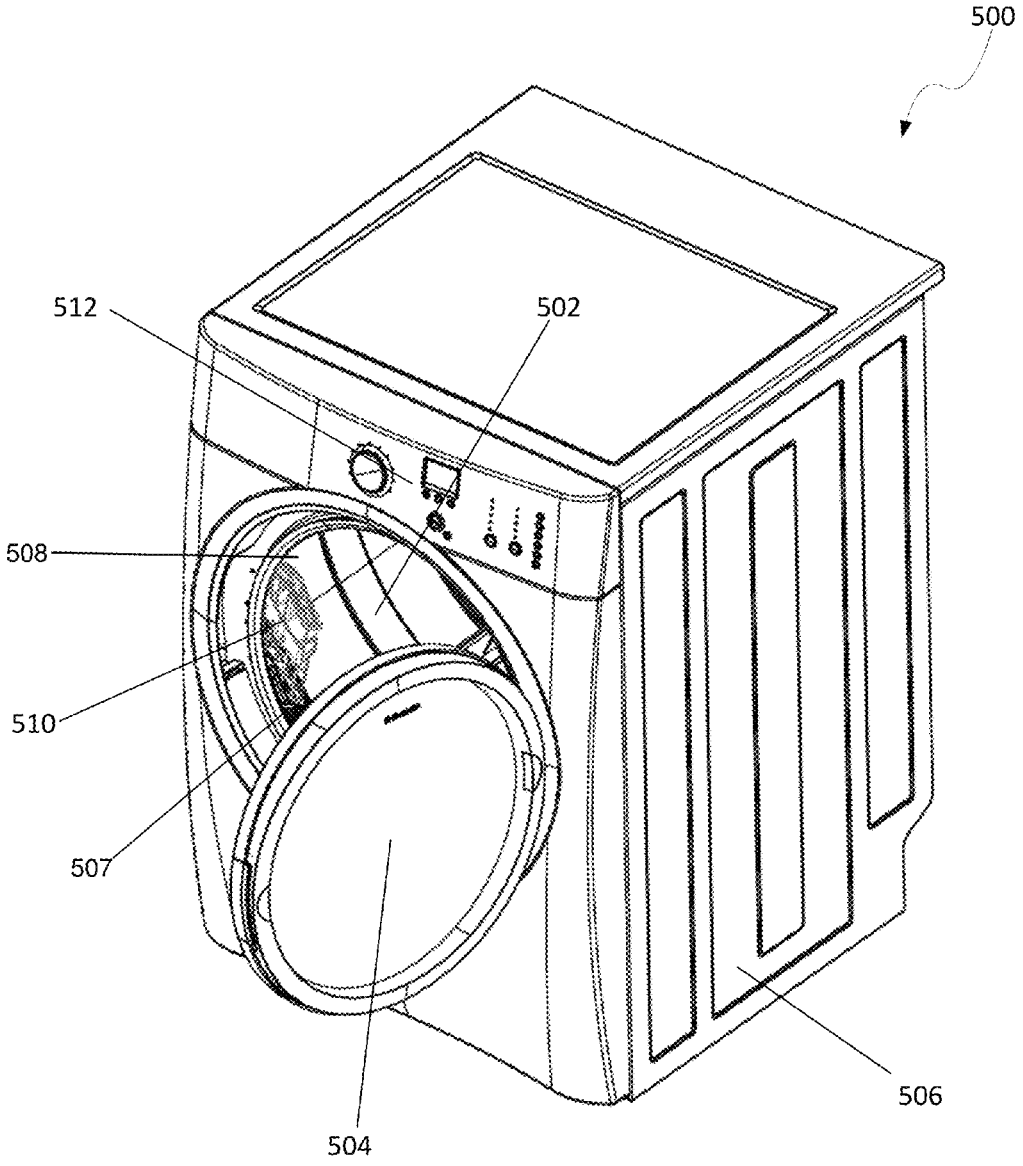
FIG. 5 is a perspective view of a complete recirculation dryer with a recirculation air filter in a partially removed state according to an embodiment of the invention.

Referring to FIG. 5, a recirculation dryer 500 according to one aspect of the invention is depicted. Recirculation dryer 500 includes cabinet 506, access door 504, drying chamber 502, and instrument panel 512. Instrument panel 512 may comprise a number of knobs, buttons, levers, touch screens, and the like used to control the operation of recirculation dryer 500. For example, in some embodiments, instrument panel 512 may allow a user to select fabric type, time of drying, temperature, and/or any other desirable aspect of recirculation dryer 500.

Recirculation dryer 500 also comprises recirculation air filter 510 which is removable and replaceable at a peripheral region 507 of access passage 508 to drying chamber 502. Specifically, recirculation air filter 510 is removably accessible by opening access door 504. In this embodiment, a user of recirculation air dryer 500 may, e.g., clean recirculation air filter 510 by simply opening access door 504 and removing recirculation air filter 510. Accordingly, when recirculation air filter 510 needs cleaning, servicing, or replacing, this can be done easily without the need to partially disassemble the cabinet 506 and/or without requiring internal scrubbers and other complex cleaners.

Figure 6:
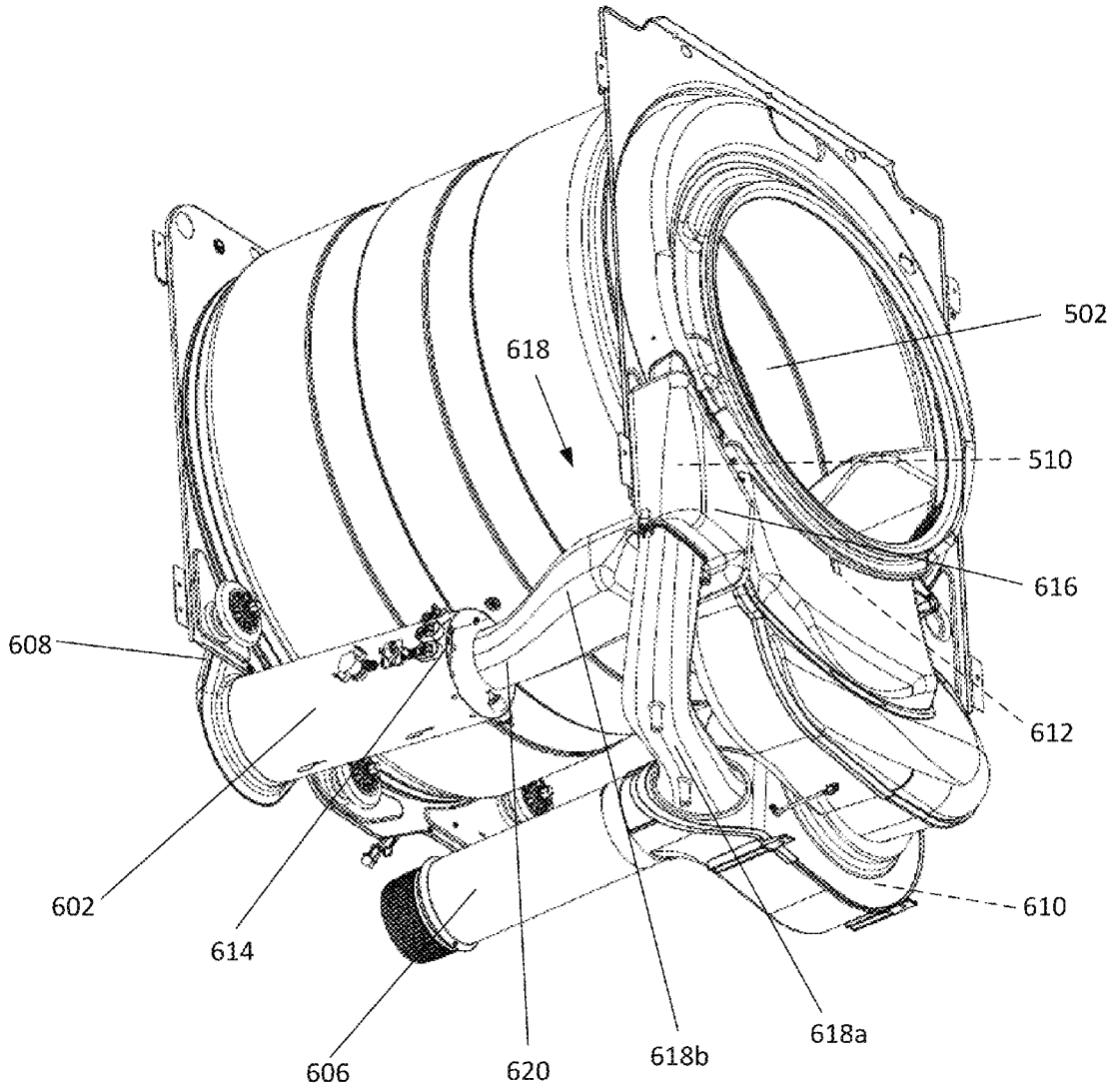
FIG. 6 is a perspective view of operative internal aspects of the recirculation dryer shown in FIG. 5.

Moving to FIG. 6, recirculation dryer 500 further comprises a process air fan 610 which generally moves air through the recirculation dryer 500. In the embodiment depicted, process air fan 610 is located downstream of drying chamber 502 and "pulls" air through drying chamber 502 by creating a negative pressure on its upstream side. Those skilled in the art will appreciate that the location of process air fan 610 in FIG. 6 is merely illustrative and that, in practice, process air fan 610 may be located in any desirable location within recirculation dryer 500 including, e.g., upstream of drying chamber 502 and/or air supply channel 602 and operating to "push" air through the drying chamber 502.

The air drawn into air supply channel 602 may comprise fresh air drawn from within cabinet 506 as well as recirculated air leaving air recirculation channel 618, as will be described in greater detail. Air supply channel 602 directs the combined fresh and recirculated air over heater 614. This heated air is then pulled through manifold 608 and into drying chamber 502. Drying chamber 502 may be of various types. In the examples depicted in FIGS. 5-17, drying chamber 502 is a well-known horizontal rotatable drum type. Clothes and other articles may be placed in drying chamber 502 by a user and, in operation, the drum rotates causing the articles within drying chamber 502 to tumble as heated air is caused to flow through drying chamber 502.

The heated air leaving drying chamber 502 passes through conventional lint filter 612. Accordingly, lint, debris, and the like picked up by the air from the laundry items are removed in a conventional fashion. However, inevitably the air will contain some fine lint and debris even after passing through lint filter 612, and/or some air containing lint, debris, and the like may bypass lint filter 612 by escaping around a gasket or other seal provided at lint filter 612. It can thus be beneficial to further filter the air before it is recirculated to further ensure avoidance of a fire hazard and/or damage to the recirculation dryer 500.

After passing through lint filter 612, the air passes through process air fan 610. As shown by the flow arrows in FIG. 6, process air fan 610 produces a negative pressure on its upstream side (thus "pulling" air through air supply channel 602, manifold 608, drying chamber 502, and lint filter 612) and a positive pressure on its downstream side (thus "pushing" air through air recirculation channel 618 and air exhaust channel 606). Air exiting process air fan 610 then splits, with a portion of the air being exhausted and a portion being recirculated. Specifically, an exhausted portion of the air will enter air exhaust channel 606 and ultimately exit the dryer. A recirculated portion of the air will enter air recirculation channel 618 and ultimately be returned to air supply channel 602.

Air recirculation channel 618 is formed by a part or assembly which is fitted between the outlet of process air fan 610 and the inlet of air supply channel 602 (as depicted, a heater canister) of recirculation dryer 500, and, more specifically, air recirculation channel 618 fluidly connects air exhaust channel 606 to air supply channel 602 (although air recirculation channel 618 may not physically touch air supply channel 602 as will be discussed in greater detail). In an installed state an upstream segment 618*a* of air recirculation channel 618 extends in a generally horizontal direction (i.e., a direction generally parallel to the floor of recirculation dryer 500) from air exhaust channel 606, and subsequently turns upward in a generally vertical direction (i.e., a direction generally perpendicular to the floor of recirculation dryer 500) as seen more clearly in FIG. 11. Because air recirculation channel 618 extends upwards from air exhaust channel 606, an outlet of air recirculation channel 618 and an inlet of air supply channel 602 may be positioned at a greater height than a junction of air recirculation channel 618 and air exhaust channel 606 with respect to the floor of recirculation dryer 500.

Housing 616 forms a part of air recirculation channel 618 at an uppermost portion of air recirculation channel 618 and has a cavity to receive the insertable recirculation air filter 510. At its upper end, a tubular section of housing 616 attaches to a correspondingly shaped/sized aperture provided in a cylindrical portion 706 of the front bulkhead of the dryer forming the dryer access opening. As mentioned, the air traveling through air recirculation channel 618 may still contain fine lint and debris despite having passed through first stage lint/air filter 612. Thus, this recirculated air is subjected to a second stage of filtering by recirculation air filter 510. Recirculation air filter 510 may be of various types suitable for removing fine particulates from air, with a preferred embodiment to be discussed in greater detail. In an installed state within housing 616, recirculation air filter 510 may be located at a greater height than air exhaust channel 606, air supply channel 602, and much of air recirculation channel 618 with respect to the floor of recirculation dryer 500.

Nozzle 620 forms a part of a downstream segment 618*b* of recirculation air channel 618 below housing 616. That is, nozzle 620 is located below most of housing 616 with respect to the floor of recirculation dryer 500 as can be seen more clearly in FIG. 12, and extends generally in a horizontal direction towards the rear of recirculation dryer 500. Nozzle 620 has a cross-sectional area which generally constricts along its length in a direction of airflow, such that a cross-sectional area of nozzle 620 where the recirculated air enters nozzle 620 (i.e., just after leaving housing 616) is larger than a cross-sectional area of nozzle 620 where the recirculated air exits nozzle 620 (i.e., just before reentering air supply channel 602).

Figure 7:
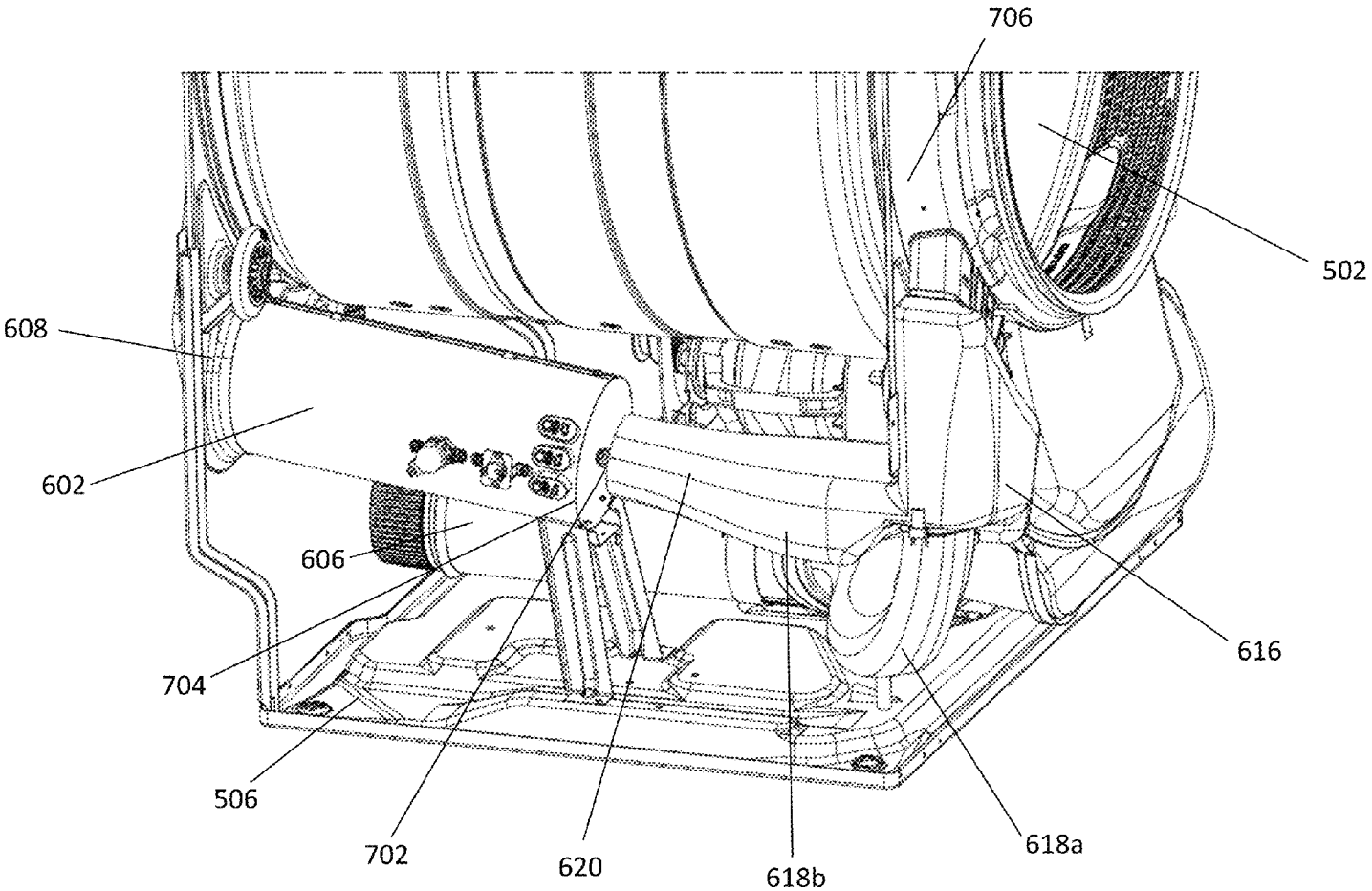
FIG. 7 is a partial perspective view of some components of the recirculation dryer shown in FIG. 5.

Turning now to FIG. 7, nozzle 620 has an outlet 702 which is positioned at the inlet 704 of air supply channel 602 (as illustrated, a heater canister). In some embodiments, outlet 702 and inlet 704 are generally circular in shape, and concentrically arranged. Specifically, outlet 702 of nozzle 620 is concentrically positioned with, but not physically connected to, inlet 704 of air supply channel 602, such that air exiting nozzle 620 at outlet 702 mixes with fresh air from inside cabinet 506 entering air supply channel 602 at inlet 704. Because the outlet 702 of nozzle 620 is radially inwardly spaced from, and not physically connected to, inlet 704 of air supply channel 602, air within cabinet 506 may enter air supply channel 602 at inlet 704 by enveloping and combining with the smaller concentric column of recirculated air exiting outlet 702. This combined air has a higher enthalpy than fresh air alone, because a portion of the air has already been previously heated. Put another way, when air leaves the drying chamber 502, all of its drying capacity may not have been used. If this air is then exhausted, the energy which was required to heat the air but which was not "used" in the drying of the articles, is wasted. When a portion of this air is recirculated through the drying chamber 502, such as described above, the unused energy can be preserved and thus the efficiency of the dryer may be increased.

Figure 8:
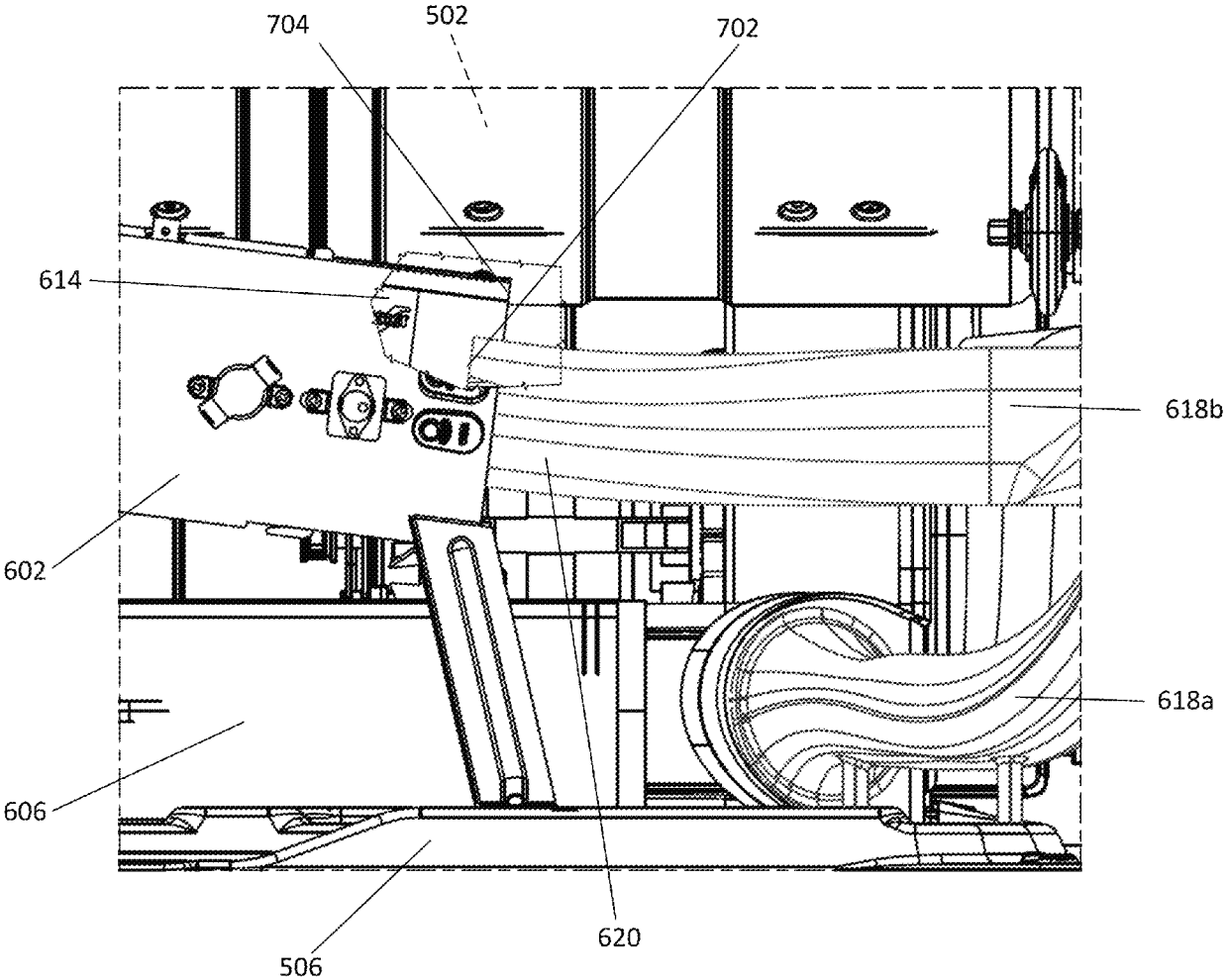
FIG. 8 is a partial side elevation view of the dryer portion illustrated in FIG. 7.
Figure 9:
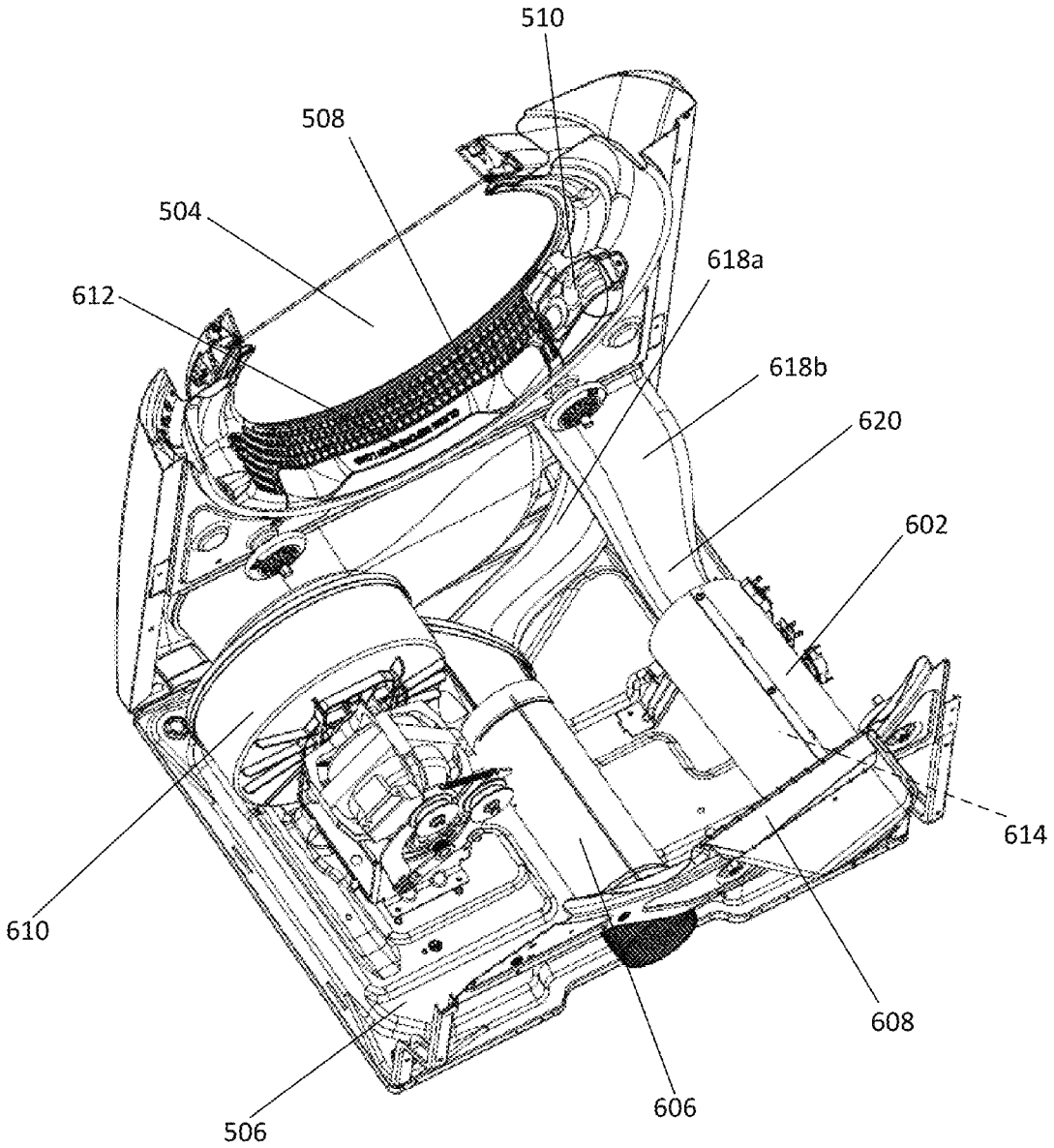
FIG. 9 is a partial perspective view showing some components of the recirculation dryer shown in FIG. 5.

FIG. 8 illustrates a placement of outlet 702 with respect to inlet 704 according to one embodiment of the invention. As illustrated, the circumference of outlet 702 is smaller than a circumference of inlet 704, and inlet 704 overlaps outlet 702. Specifically, nozzle 620 of air recirculation channel 618 is positioned inside air supply channel 602 such that outlet 702 is downstream of fresh air from within cabinet 506 entering air supply channel 602 at inlet 704. Accordingly, the recirculated air exiting nozzle 620 at outlet 702 will be recirculated to drying chamber 502. Further, fresh air from cabinet 506 will enter air supply channel 602 at the opening between a circumference of nozzle 620 and the circumference of air supply channel 602 at the location of inlet 704.

Figure 1:
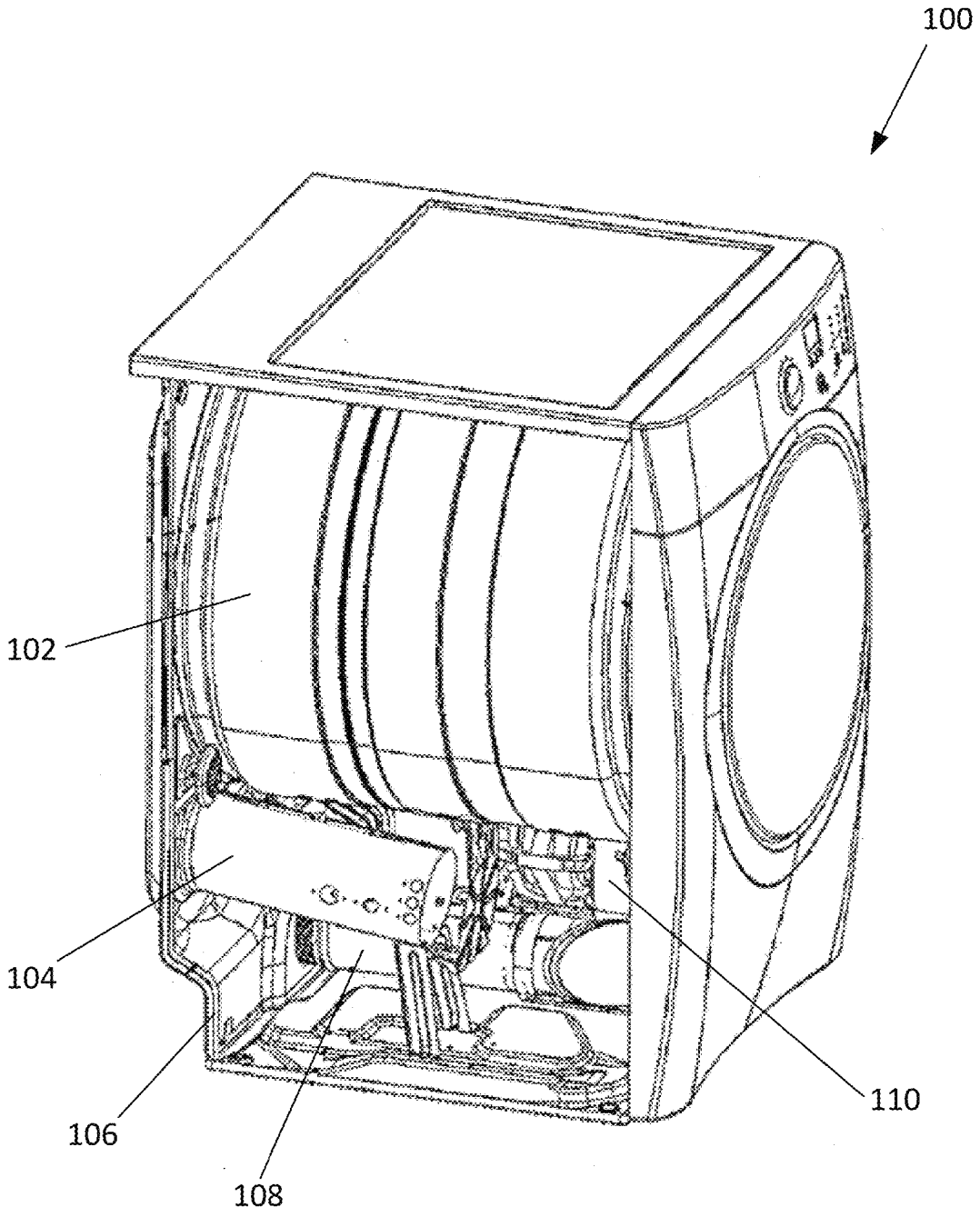
FIG. 1 Related Art
FIG. 1 is a perspective view of a conventional vented tumble dryer with a portion of the dryer housing removed to illustrate internal components.
Figure 2:
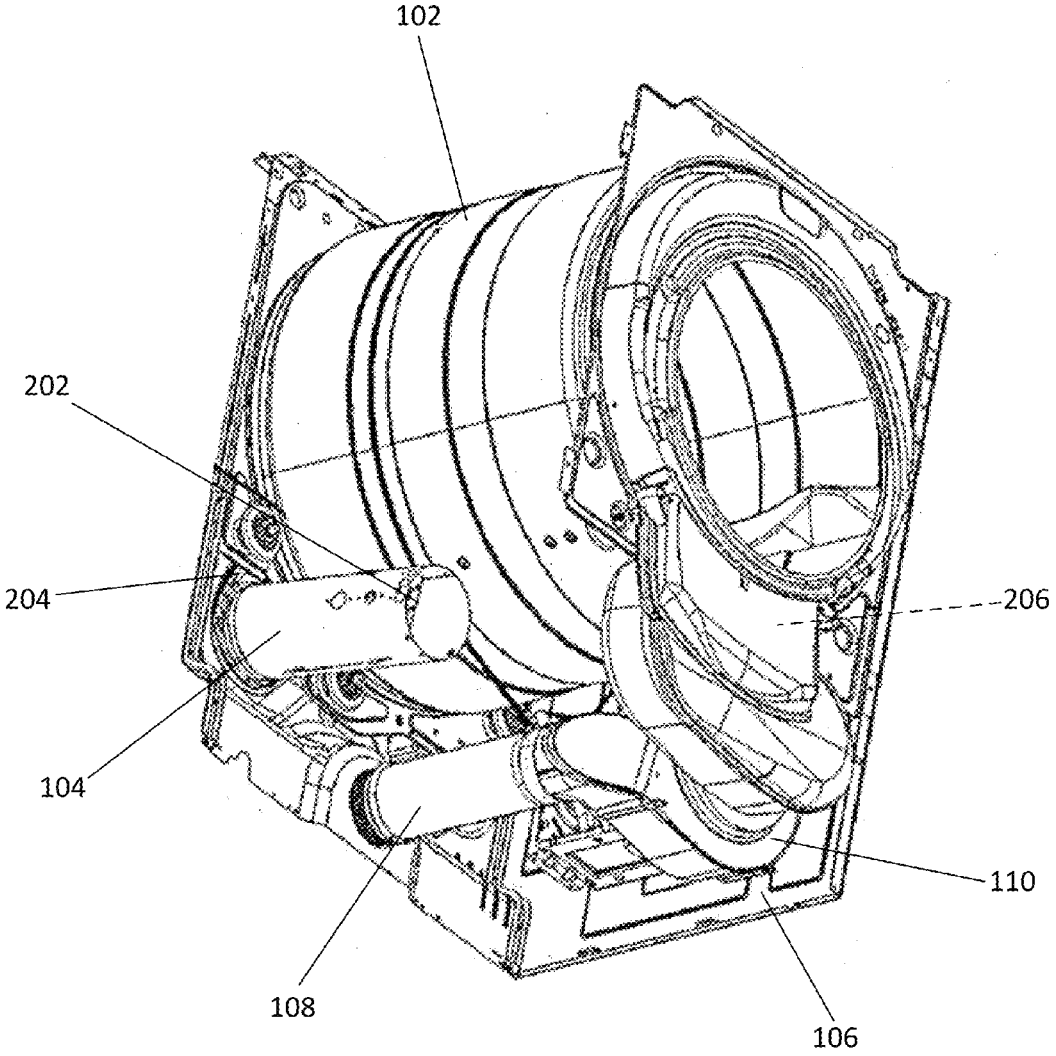
FIG. 2 Related Art
FIG. 2 is an alternative perspective view of the conventional dryer shown in FIG. 1 with cabinet panels removed.
Figure 3:
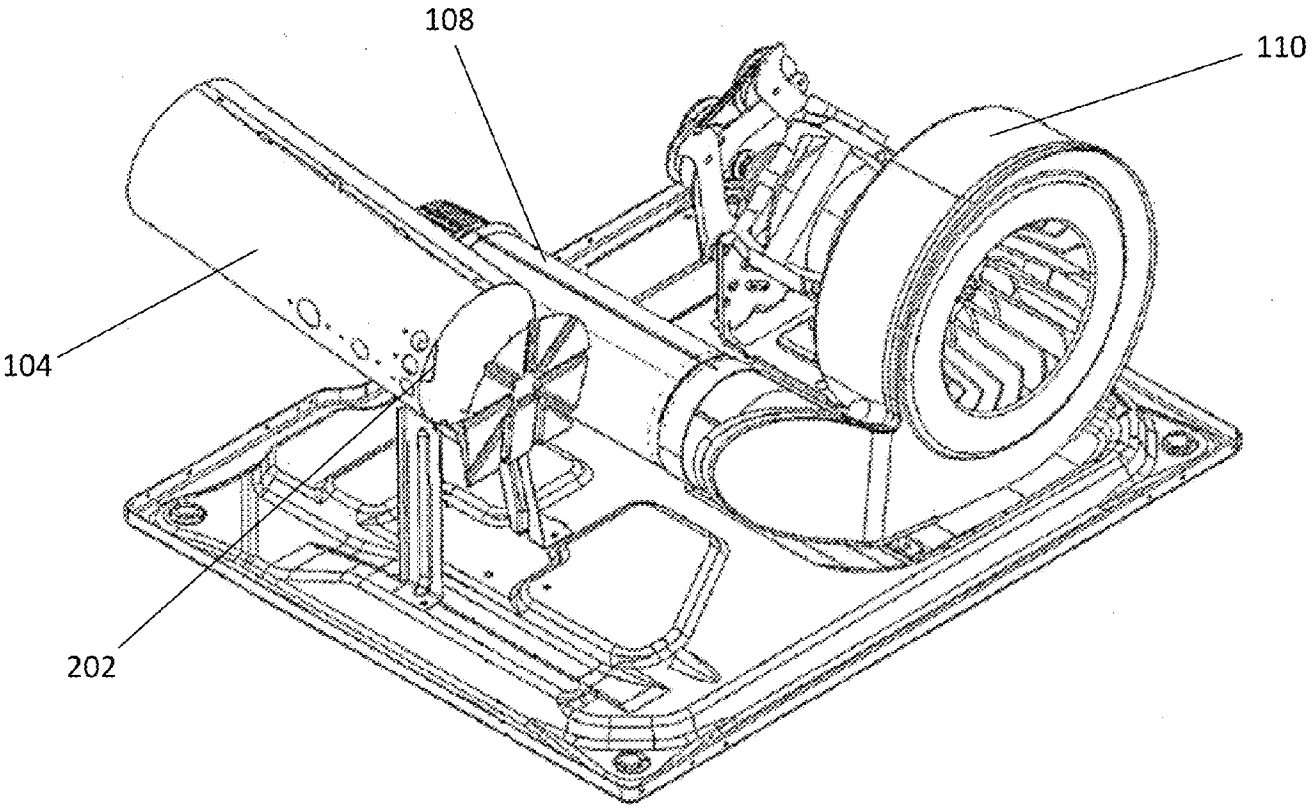
FIG. 3 Related Art
FIG. 3 is a perspective view of some components of the conventional dryer shown in FIG. 1.
Figure 4:
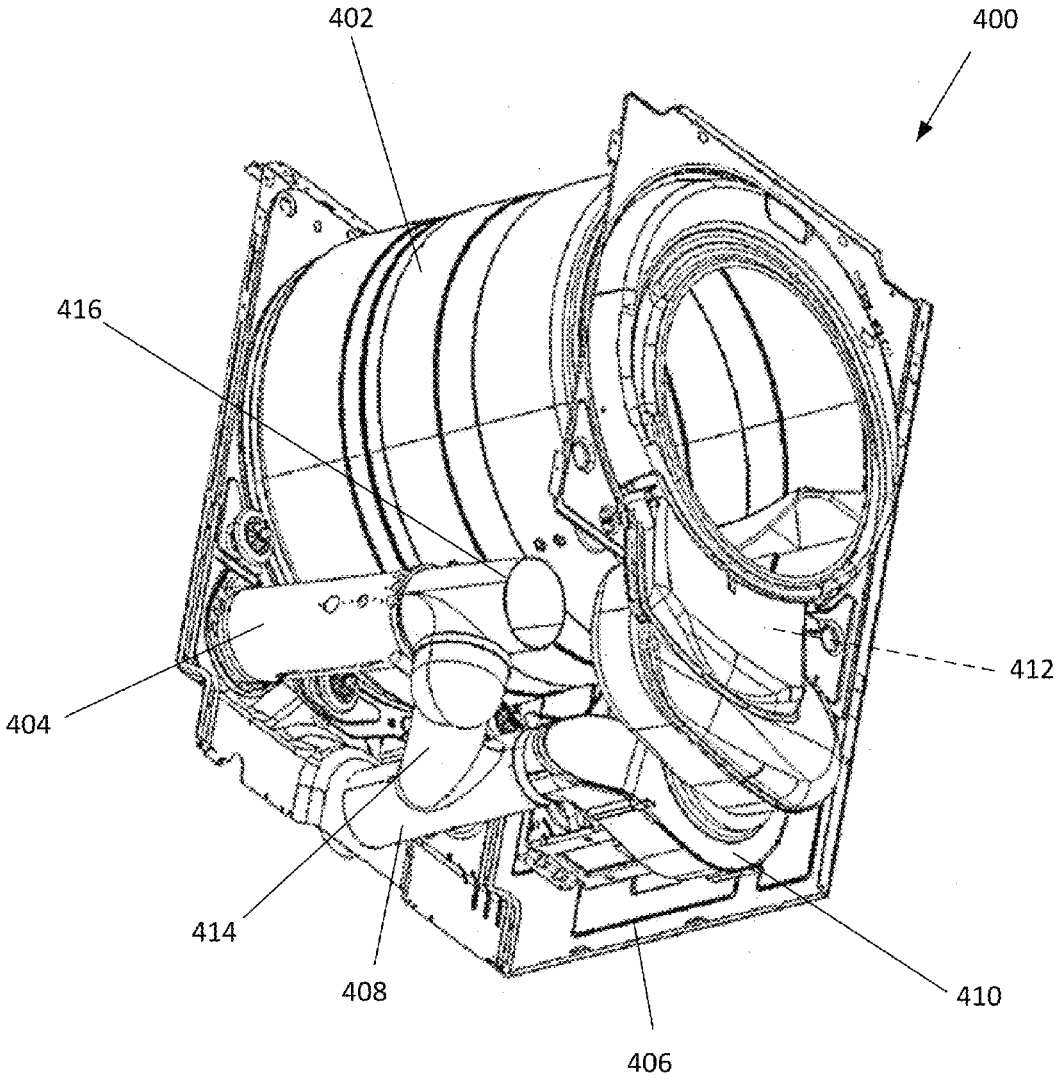
FIG. 4 Related Art
FIG. 4 is a perspective view of a related art recirculation vented tumble dryer with a portion of the dryer housing removed to illustrate internal components.

Those skilled in the art, given the benefit of this disclosure, will appreciate that the arrangement illustrated in, e.g., FIG. 8, is merely illustrative of one suitable arrangement of outlet 702 with respect to inlet 704, and, in other embodiments, the actual arrangement and/or structure of outlet 702 and inlet 704 may vary without departing from the disclosure. For example, as depicted in FIG. 4 and described in more detail in commonly owned U.S. patent application Ser. No. 13/437,499 (incorporated by reference in its entirety), in some embodiments the recirculation channel 618 may be physically connected to the air supply channel 602. In such embodiments, outlet 702 may physically connect and/or be integrally formed with inlet 704.

In some embodiments, a desired ratio of fresh air from within cabinet 506 to recirculated air may be achieved by providing an appropriate cross-sectional area of outlet 702 and/or an appropriate cross-sectional area of an inlet to upstream segment 618*a* of air recirculation channel 618. For example, in some embodiments, the cross-sectional area of outlet 702 may be much smaller than the cross-sectional area of inlet 704, and thus the area between the circumference of the nozzle 620 and the circumference of inlet 704 at a location of inlet 704 will be greater than the cross-sectional area of outlet 702. In such an embodiment, more fresh air from within cabinet 506 may ultimately be supplied to drying chamber 502 than recirculated air. In other embodiments, the cross-sectional area of outlet 702 may be closer in size to the cross-sectional area of inlet 704, such that the area between the circumference of the nozzle 620 and the circumference of inlet 704 at a location of inlet 704 will be equal to or smaller than the cross-sectional area of outlet 702. In such an embodiment, more recirculated air may ultimately be supplied to drying chamber 502 than fresh air from within cabinet 506. Further, the rate of recirculated airflow from the outlet 702 may be greater than the rate of fresh airflow into the inlet 704, due to the relatively high pressure drops generated at the downstream side of the blower 610.

Other aspects of recirculation air channel 618 may also influence the ratio of fresh air from within the cabinet 506 to recirculated air ultimately provided to drying chamber 502. For example, in some embodiments an angle that upstream segment 618*a* of air recirculation channel 618 forms with air exhaust channel 606 may be such that the influence of dynamic pressure on the amount of air entering the air recirculation channel 618 is limited. In other embodiments, the relative cross-section of air recirculation channel 618 may reduce the amount of recirculated air traveling through air recirculation channel and ultimately supplied to air supply channel 602. For example, a controlling (i.e., minimum) cross-section of air recirculation channel 618 can be made smaller than the controlling cross-section of air exhaust channel 606 in order to control the amount of recirculated air entering air recirculation channel 618 as compared to fresh air entering air supply channel 602. In still other embodiments, various flaps, dampers, and the like may be employed to direct and or regulate recirculated air in air recirculation channel 618. Further, a size of openings in the mesh-filter material 1310 provided on recirculation air filter 510 (to be more fully discussed) may affect the rate of airflow in air recirculation channel 618 and, in some embodiments, ultimately the ratio of recirculated air to fresh air supplied to drying chamber 502.

In some embodiments, the part forming air recirculation channel 618 as described above may be integrally formed as one plastic piece, such as by blow molding. In such an embodiment, the entirety of air recirculation channel 618 extending from the junction with the air exhaust channel 606 to the outlet at the air supply channel 602 (including housing 616 and nozzle 620) will be formed by the single piece. Alternatively, air recirculation channel 618 may comprise several components which are attached to one another during installation; e.g., duct work sections formed of galvanized or sheet metal suitable high temperature tolerant plastic material. For example, an upstream segment 618*a* (i.e., an elbow portion) of the air recirculation channel 618 extending from the junction with air exhaust channel 606 to the housing 616 may be blow molded or otherwise constructed separately from housing 616, which may be blow molded otherwise constructed separately from a downstream portion 618*b* of the air recirculation channel 618 comprising nozzle 620. Each component may then be connected when assembled and/or installed in recirculation dryer 500 by ultrasonic welding, spot welding, screws, or any other manner generally known in the art.

Following the geometry of the air recirculation channel 618 as presented above, recirculated air flows generally vertically when being filtered and generally horizontally when splitting from the exhaust portion and when reentering air supply channel 602. Specifically, after splitting from the portion of air exhausted at air exhaust channel 606, the recirculated air travels generally horizontally in an upstream segment 618*a* of air recirculation channel 618 towards a side panel of recirculation dryer 500 before turning generally vertical towards housing 616. The air thus flows generally vertically into housing 616 containing recirculation air filter 510 where it exits along one or more sides of recirculation air filter 510 into airflow spacing provided in housing 616. Housing 616 is provided in fluid connection with a downstream segment 618*b* of recirculation channel 618 leading to nozzle 620. From the airflow spacing in housing 616, the recirculated air thus flows downward towards downstream segment 618*b* and, in some embodiments, generally horizontally through nozzle 620 towards air supply channel 602. In some embodiments, the air leaving nozzle 620 is then combined with fresh air from inside dryer cabinet 506 as detailed above for another pass through the airflow circuit.

Figure 14:
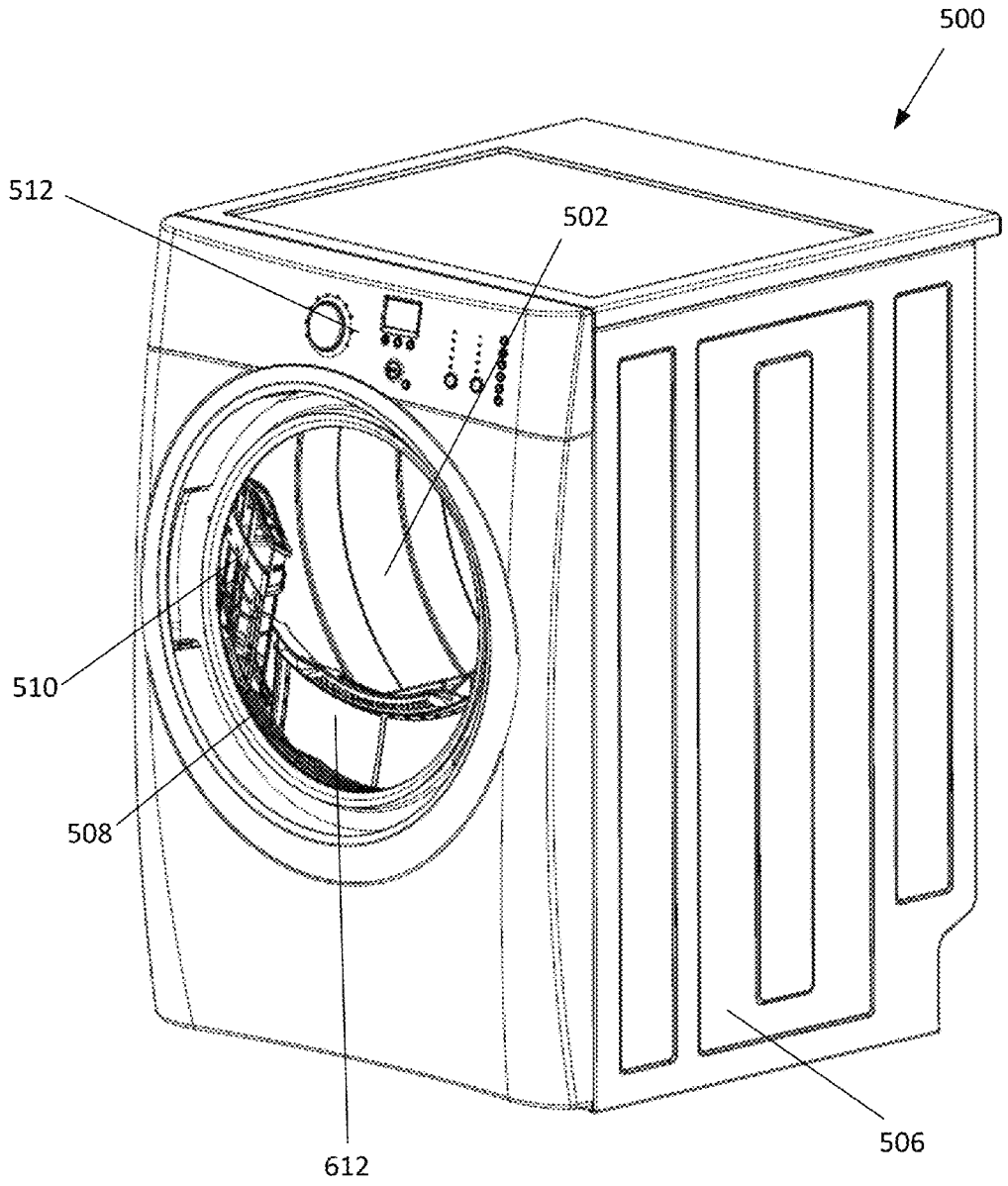
FIG. 14 is another perspective view of the recirculation dryer shown in FIG. 5 with the access door removed to show a recirculation air filter and a conventional lint filter in a partially removed state.

Recirculation air filter 510 is conveniently removably accessible from the air recirculation channel 618 by a user of the recirculation dryer 500. As detailed in FIGS. 9 and 14, recirculation air filter 510 is removable and replaceable at a peripheral region of the loading/unloading access passage 508 to drying chamber 502. Recirculation air filter 510 fits within an elongated, generally vertically oriented cavity formed within housing 616 next to lint filter 612. A user of recirculation dryer 500 may place articles to be dried in drying chamber 502 by opening access door 504 and passing the articles through access passage 508. As is well-known in the art, conventional lint filter 612 may comprise a handle located at the peripheral region of access passage 508 for use in removing and replacing the filter. Similarly, in one embodiment of the invention, a handle of recirculation air filter 510 is provided at the peripheral region of access passage 508 next to the handle of the conventional lint filter 612. A user of recirculation dryer 500 may remove recirculation air filter 510 by simply opening access door 504, grasping the handle, and applying a pulling force to counteract a securing mechanism (if any) that may serve to hold the filter in place. The user may thus periodically remove the recirculation air filter 510, inspect it, and, as necessary (e.g., before or after each use of the dryer) clean off any lint and/or debris accumulated on the filter, in a manner similar to conventional lint filter 612 as illustrated in FIG. 14.

The handle of recirculation air filter 510 may be shaped such that its contour matches that of the arcuate peripheral region of access passage 508. For example, in the illustrated embodiment, the peripheral region of access passage 508 is substantially cylindrical shaped, and the handle of recirculation air filter 510 is substantially arcuate shaped with a same radius of curvature as the peripheral region of access passage 508. In such a configuration, recirculation air filter 510 may be conveniently and removably accessible for periodic cleaning without interfering with the loading and unloading of the dryer 500 when the recirculation air filter 510 is in an installed state.

Figure 10:
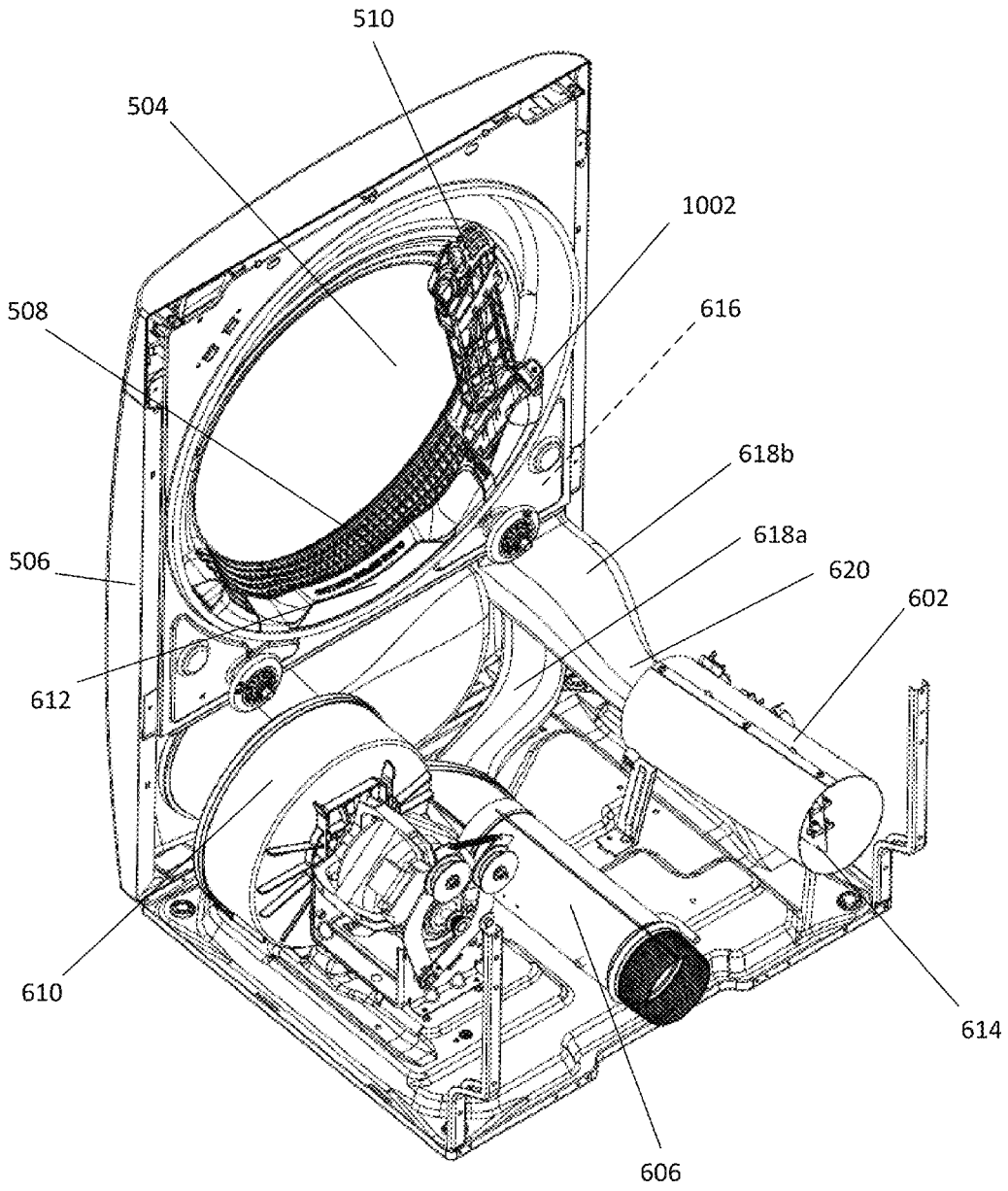
FIG. 10 is a partial perspective view showing a portion of the recirculation dryer shown in FIG. 5 with a recirculation air filter in a partially removed state.

Moving to FIG. 10, recirculation air filter 510 is shown in a partially removed state. As depicted, recirculation air filter 510 has a rectangular outer perimeter substantially corresponding to the transverse cross-sectional shape of opening 1002 in housing 616, and somewhat smaller so as to be freely moveable into and out from housing 616 of air recirculation chamber 618. Housing 616 may comprise a ledge, latch, catch, or some other mechanism to seat recirculation air filter 510 in place. Recirculation air filter 510 may thus be inserted into opening 1002 by a user until it securely engages housing 616. While seated in this operable position, respective upper perimeters of the recirculation air filter 510 and housing 616 may be configured to engage each other in an airtight fashion such that air from within the drying chamber 502 does not enter opening 1002 and ultimately housing 616 during operation, and such that recirculated air in housing 616 does not escape to the drying chamber 502 during operation.

Figure 11:
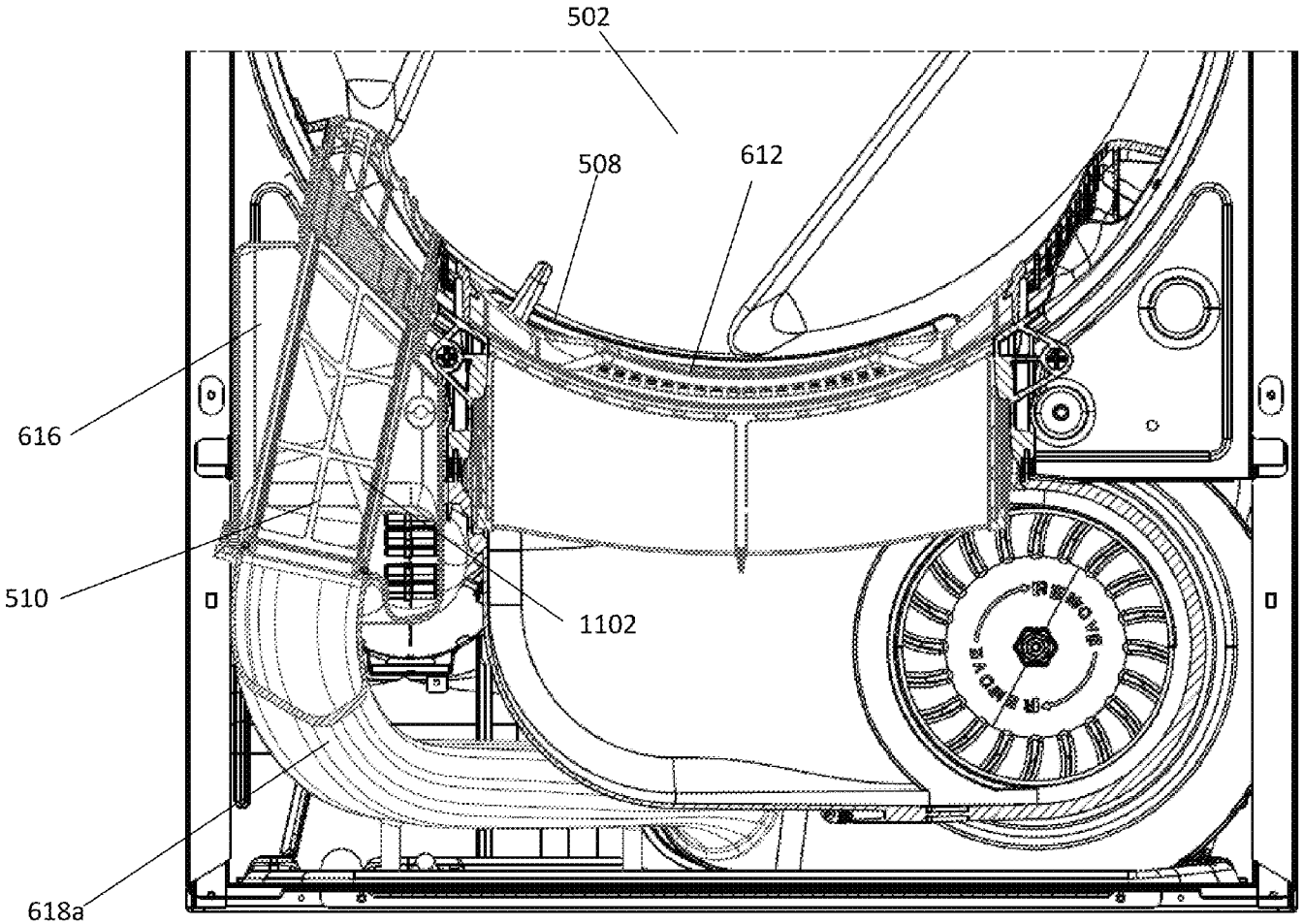
FIG. 11 is a view of the generally vertical housing for a recirculation air filter included in the recirculation dryer shown in FIG. 5 with portions of the recirculation channel structure removed to illustrate internal components.
Figure 12:
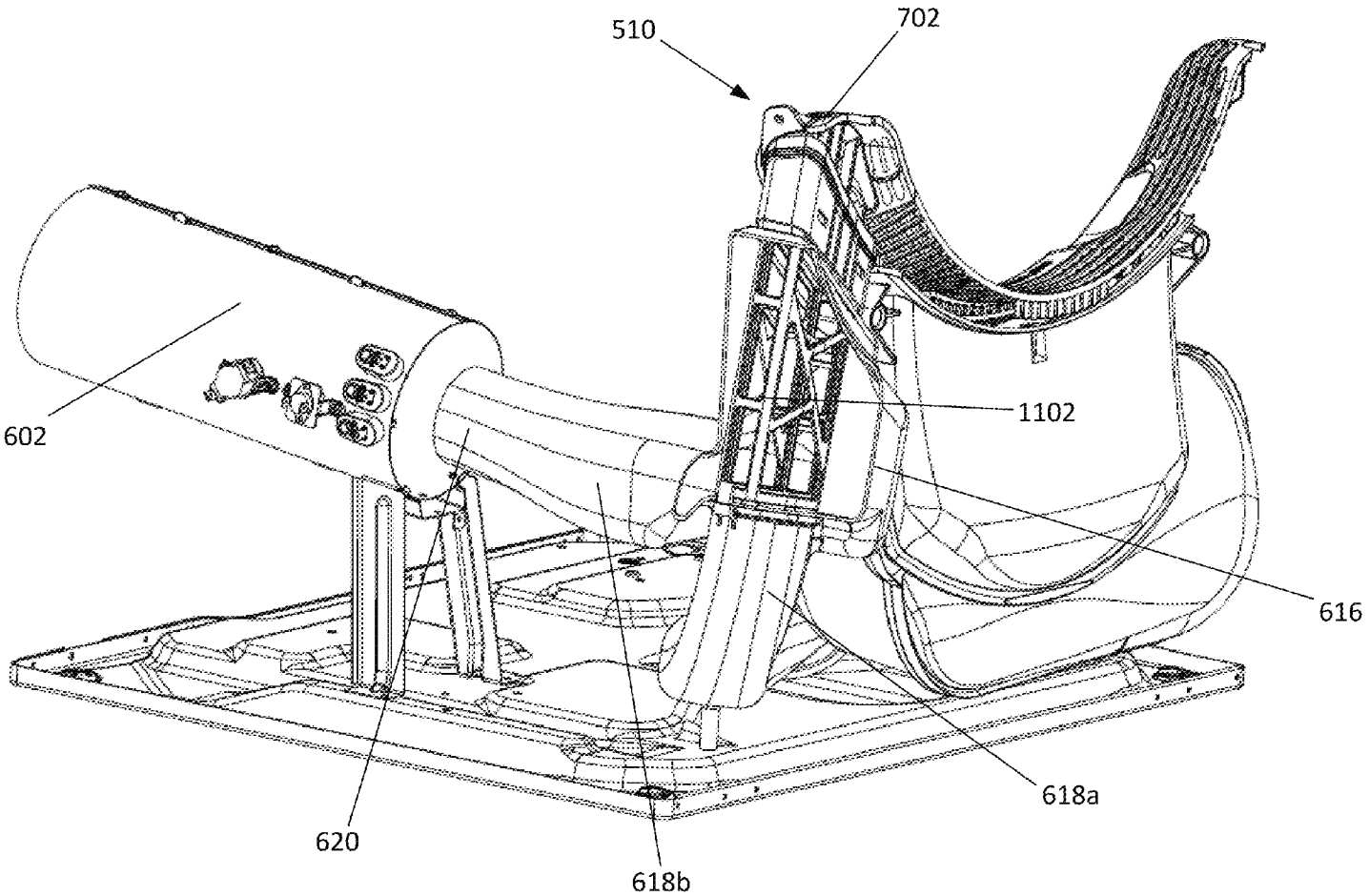
FIG. 12 is a partial perspective view of the recirculation dryer shown in FIG. 5 showing the recirculation air filter in an installed state with a portion of the recirculation channel structure removed to illustrate the installed state.
Figure 15:
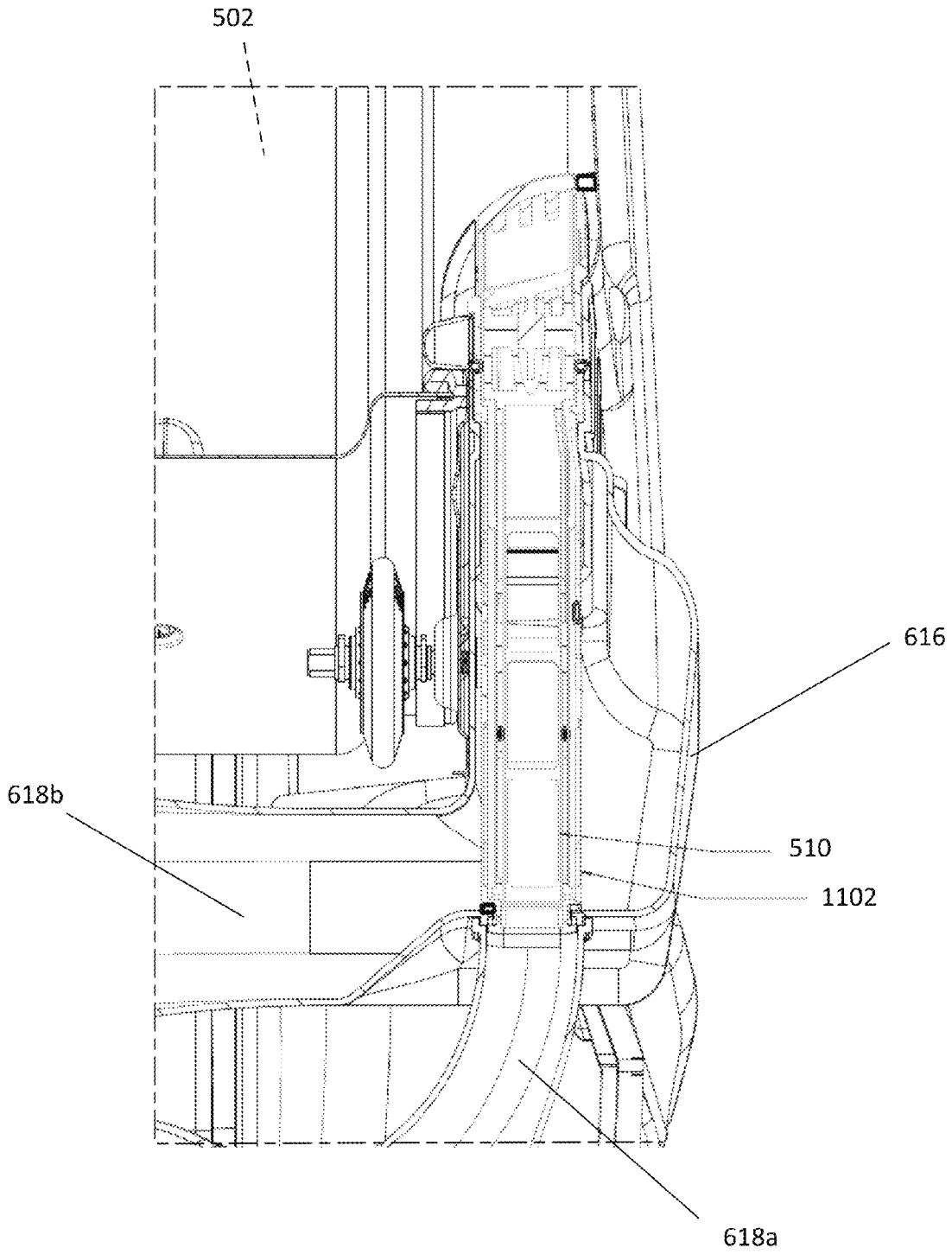
FIG. 15 is a partial cross-sectional view of the recirculation dryer shown in FIG. 5 with the recirculation air filter in an installed state.

As shown in FIGS. 11, 12, and 15, housing 616 may seat recirculation air filter 510 in a generally vertical orientation. In some embodiments, housing 616 comprises filter guide 1102. Filter guide 1102 and/or the shape of recirculation air filter 510 may seat recirculation air filter 510 in a generally vertical orientation within housing 615. Filter guide 1102 comprises a framework which guides recirculation air filter 510 during installation and removal such that recirculation air filter 510 is ultimately seated in the appropriate operable position. In this operable position, recirculation air filter 510 is generally vertical (i.e., within 30 degrees of vertical) and has airflow spacing about its sides and the walls of housing 616 as shown in FIGS. 12 and 15. Thus, when a user inserts recirculation air filter 510 into opening 1002, filter guide 1102 guides recirculation air filter 510 into place such that recirculation air filter 510 is seated in a position where recirculated air may appropriately flow through the recirculated air filter 510 as will be discussed in greater detail.

Figure 13:
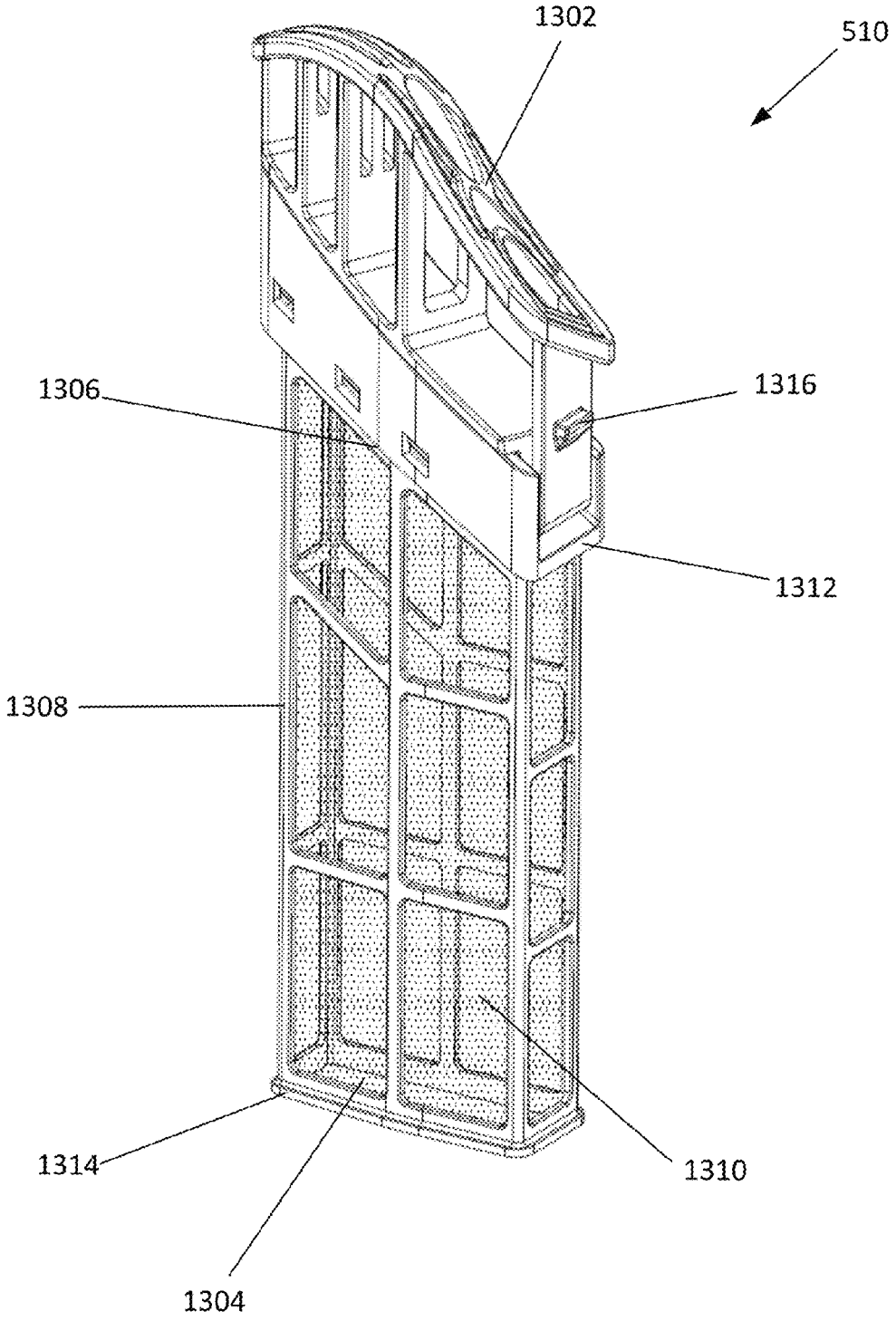
FIG. 13 is a perspective view of the recirculation air filter included in the exemplary recirculation dryer of FIGS. 5-12 and 14-15.

As shown in FIG. 13, recirculation air filter 510 is formed generally as an elongated cartridge with a substantially rectangular cross-section comprising an open lower end 1304, a closed upper (handle) end 1306, framework 1308, mesh-filter material 1310, handle 1302, and latch 1316. More specifically, recirculation air filter 510 is generally in the form of a hollow shell, wherein a cavity within the shell is bounded on top by closed end 1306, on each side by framework 1308 comprising mesh-filter material 1310, and open at the bottom end 1304. Handle 1302 is accessible by a user for removing the recirculation air filter 510 from recirculation dryer 500, and may be shaped to contour to the peripheral region of access passage 508 as discussed above. Closed end 1306, formed by the bottom end of handle structure 1302, may comprise protruding lip or overhang 1312 along one or more of the sides of recirculation air filter 510. Lip 1312 may engage a ledge or other feature of housing 616 when recirculation air filter 510 is inserted into opening 1002 of housing 616 in order to seat recirculation air filter 510 in the appropriate operable position and to create a generally airtight seal between housing 616 and drying chamber 502. In some embodiments, lip 1312 may further comprise a gasket or other seal (not shown) such that lip 1312 engages housing 616 in a generally airtight manner to prevent recirculated air within housing 616 from escaping around recirculation air filter 510 and into drying chamber 502.

Recirculation air filter 510 may further comprise gasket-like sealing member 1314. Sealing member 1314 may engage a lower portion of housing 616 in an airtight manner such that the portion of air being recirculated in housing 616 (and thus passed through recirculation air filter 510) does not escape around the edges of recirculation air filter 510 and thus bypass recirculation air filter 510. Sealing member 1314 may be any well-known O-ring, sealing material, and/or gasket-like material. Recirculation air filter 510 may further comprise latch 1316 which secures recirculation air filter 510 into housing 616. For example, latch 1316 may be biased towards a notch (not shown) provided in an upper opposing portion of housing 616 when recirculation air filter 510 is in an operable state. When removing recirculation air filter 510, a user may thus apply a pulling force to handle 1302 which counteracts the bias force of latch 1316 and unseats recirculation air filter 510 from housing 616.

In operation, recirculated air is directed through open end 1304 in the aforementioned generally vertical direction by air recirculation channel 618. The air continues to flow generally vertically until it reaches the recirculation air filter 510. The recirculated air will then be dispersed outwardly through framework 1308 and mesh-filter material 1310 mounted thereon, into the airflow spacing surrounding the recirculation air filter 510. The mesh-filter material 1310 may thus perform the desired filtering of the recirculated air. In some embodiments, the mesh-filter material 1310 may be of a type used in lint filter 612. In other embodiments, the mesh-filter material 1310 may be finer than the mesh used on lint filter 612, and thus may filter particulates which, due to their small size, were not previously filtered at lint filter 612. For example, mesh-filter material 1310 may be polyester or polypropylene. The filtered recirculated air will then be directed out of housing 616, to the downstream segment 618*b* of air recirculation channel 618, and, in some embodiments, ultimately through nozzle 620 to air supply channel 602 as detailed above. Any lint, debris, or any other particulates will thus remain on mesh-filter material 1310, and may be easily removed by a user accessing the recirculation air filter 510 at the peripheral region of access passage 508. When removed, a user may, e.g., run the recirculation air filter 510 under water to remove any lint and/or debris collected on mesh-filter material 1310. In other embodiments, recirculation air filter 510 may comprise, e.g., one or more snap fittings or the like (not shown) such that framework 1308 may be opened allowing a user easier access to the internal side of mesh filter material in order to remove any lint and/or debris collected on mesh-filter material 1310.

In some embodiments, recirculation air filter 510 (excluding mesh-filter material 1310 and sealing member 1314) may be formed as one integral piece, such as by injection molding suitable plastic material. In other embodiments, recirculation air filter 510 may comprise several components which are combined to ultimately form recirculation air filter 510. For example, in some embodiments, framework 1308 may be molded or otherwise constructed separately from the upper handle portion and then bonded or otherwise attached to one another. Mesh-filter material 1310 and sealing member 1314 may then be attached to the structure of recirculation air filter 510 using well-known methods. In other embodiments, the mesh-filter material 1310 may be attached during the molding process of recirculation air filter 510 such that the mesh-filter material 1310 is integrally formed with, e.g., framework 1308. For example, in some embodiments mesh-filter material 1310 may be introduced to a mold (e.g., a mold for framework 1308) and a molten plastic or the like may then be injected into the mold over the mesh such that, when the molten plastic solidifies, the mesh-filter material 1310 will be integrally formed with the framework 1308.

The present invention has been described in terms of preferred and exemplary embodiments thereof. Numerous other embodiments, modifications, and variations within the scope and spirit of the appended claims will occur to persons of ordinary skill in the art from the review of this disclosure.

We claim:

1. A vented laundry dryer comprising:
- a cabinet;
- a drying chamber provided within the cabinet;
- an air supply channel configured to supply air to the drying chamber;
- a heater configured to heat the air supplied to the drying chamber;
- a process air fan configured to move the air through the drying chamber;
- an air exhaust channel configured to exhaust a first portion of the air from the drying chamber;
- an air recirculation channel configured to direct a second portion of the air from the drying chamber to the air supply channel;
- a recirculation air filter provided in the air recirculation channel and configured to filter the air in the air recirculation channel, wherein the recirculation air filter is removable and replaceable at a peripheral region of an access passage to the drying chamber; and
- a first stage air filter provided upstream of the process air fan, wherein the first stage air filter is removable and replaceable at the peripheral region of the access passage to the drying chamber.

2. The vented laundry dryer of claim 1, wherein the peripheral region of the access passage is located behind an access door covering the access passage.

3. The vented laundry dryer of claim 1, wherein the air recirculation channel and the recirculation air filter are provided downstream of the process air fan.

4. The vented laundry dryer of claim 1, wherein a location of the recirculation air filter at the peripheral region of the access passage to the drying chamber is higher than a location of the first stage air filter at the peripheral region of the access passage to the drying chamber with respect to a floor of the vented laundry dryer.

5. The vented laundry dryer of claim 1, wherein the recirculation air filter is insertable into a housing forming part of the air recirculation channel such that, in an inserted position, the housing provides airflow spacing on a plurality of sides of the recirculation air filter.

6. The vented laundry dryer of claim 5, wherein the recirculation air filter is insertable into the housing in a generally vertical orientation.

7. The vented laundry dryer of claim 1, wherein the recirculation air filter comprises a framework supporting mesh-filter material.

8. The vented laundry dryer of claim 7, wherein the recirculation air filter is in a form of a hollow shell further comprising an open end provided at a bottom of the hollow shell, and a closed end provided at a top of the hollow shell, wherein the framework supporting the mesh-filter material extends from the open end to the closed end, and wherein the air recirculation channel is further configured to direct the second portion of the air through the recirculation air filter such that the second portion of the air enters the recirculation air filter through the open end and exits the recirculation air filter through the mesh-filter material.

9. The vented laundry dryer of claim 8, wherein the recirculation air filter has a substantially rectangular cross-sectional shape.

10. The vented laundry dryer of claim 8, wherein the recirculation air filter further comprises a handle provided at the closed end, and wherein the recirculation air filter is further configured to be removable and replaceable at the peripheral region of the access passage to the drying chamber via the handle.

11. The vented laundry dryer of claim 10, wherein the handle has an arcuate contour generally following an arcuate contour of the peripheral region of the access passage to the drying chamber.

12. The vented laundry dryer of claim 11, wherein the peripheral region of the access passage to the drying chamber is generally cylindrical having a first radius of curvature, and wherein the handle is generally arcuate having the first radius of curvature.

13. The vented laundry dryer of claim 1, wherein the air supply channel comprises an inlet at an entrance to the air supply channel in open communication with air provided in the cabinet, wherein the air recirculation channel comprises an outlet at an exit of the air recirculation channel concentrically arranged within the inlet, and wherein air within the cabinet enters the air supply channel at an opening between a circumference of the inlet and a circumference of the air recirculation channel at the inlet.

14. The vented laundry dryer of claim 1, wherein a gap is formed between an outlet of the air recirculation channel and an inlet of the air supply channel through which fresh air from the cabinet may enter the air supply channel together with recirculation air flow.

15. A vented laundry dryer comprising:

a cabinet;

a drying chamber provided within the cabinet;

an air supply channel configured to supply air to the drying chamber;

a heater configured to heat the air supplied to the drying chamber;

a process air fan configured to move the air through the drying chamber;

an air exhaust channel configured to exhaust a first portion of the air from the drying chamber;

an air recirculation channel configured to direct a second portion of the air from the drying chamber to the air supply channel; and a recirculation air filter provided in the air recirculation channel and configured to filter the air in the air recirculation channel, wherein the recirculation air filter is removable and replaceable at a peripheral region of an access passage to the drying chamber;

wherein the recirculation air filter is insertable into a housing forming part of the air recirculation channel such that, in an inserted position, the housing provides airflow spacing on a plurality of sides of the recirculation air filter.

16. The vented laundry dryer of claim 15, wherein the recirculation air filter is insertable into the housing in a generally vertical orientation.

17. A vented laundry dryer comprising:

a cabinet;

a drying chamber provided within the cabinet;

an air supply channel configured to supply air to the drying chamber;

a heater configured to heat the air supplied to the drying chamber;

a process air fan configured to move the air through the drying chamber;

an air exhaust channel configured to exhaust a first portion of the air from the drying chamber;

an air recirculation channel configured to direct a second portion of the air from the drying chamber to the air supply channel; and a recirculation air filter provided in the air recirculation channel and configured to filter the air in the air recirculation channel, wherein the recirculation air filter is removable and replaceable at a peripheral region of an access passage to the drying chamber;

wherein the recirculation air filter comprises a framework supporting mesh-filter material and the recirculated air filter is in a form of a hollow shell further comprising an open end provided at a bottom of the hollow shell, and a closed end provided at a top of the hollow shell, wherein the framework supporting the mesh-filter material extends from the open end to the closed end, and wherein the air recirculation channel is further configured to direct the second portion of the air through the recirculation air filter such that the second portion of the air enters the recirculation air filter through the open end and exits the recirculation air filter through the mesh-filter material.

18. The vented laundry dryer of claim 17, wherein the recirculation air filter has a substantially rectangular cross-sectional shape.

19. The vented laundry dryer of claim 17, wherein the recirculation air filter further comprises a handle provided at the closed end, and wherein the recirculation air filter is further configured to be removable and replaceable at the peripheral region of the access passage to the drying chamber via the handle.

20. The vented laundry dryer of claim 19, wherein the handle has an arcuate contour generally following an arcuate contour of the peripheral region of the access passage to the drying chamber.

21. The vented laundry dryer of claim 20, wherein the peripheral region of the access passage to the drying chamber is generally cylindrical having a first radius of curvature, and wherein the handle is generally arcuate having the first radius of curvature.

22. A vented laundry dryer comprising:

a cabinet;

a drying chamber provided within the cabinet;

an air supply channel configured to supply air to the drying chamber;

a heater configured to heat the air supplied to the drying chamber;

a process air fan configured to move the air through the drying chamber;

an air exhaust channel configured to exhaust a first portion of the air from the drying chamber;

an air recirculation channel configured to direct a second portion of the air from the drying chamber to the air supply channel; and a recirculation air filter provided in the air recirculation channel and configured to filter the air in the air recirculation channel, wherein the recirculation air filter is removable and replaceable at a peripheral region of an access passage to the drying chamber;

wherein the air supply channel comprises an inlet at an entrance to the air supply channel in open communication with air provided in the cabinet, wherein the air recirculation channel comprises an outlet at an exit of the air recirculation channel concentrically arranged within the inlet, and wherein air within the cabinet enters the air supply channel at an opening between a circumference of the inlet and a circumference of the air recirculation channel at the inlet.

* * * * *